US005285050A

United States Patent [19]

Blackburn

[11] Patent Number: 5,285,050

[45] Date of Patent: Feb. 8, 1994

[54] BATTERY-OPERATED PORTABLE CIGARETTE LIGHTER WITH CLOSURE ACTUATED SWITCH

[75] Inventor: William G. Blackburn, Clearwater, Fla.

[73] Assignee: Electra-Lite, Inc., Clearwater, Fla.

[21] Appl. No.: 924,781

[22] Filed: Aug. 4, 1992

Related U.S. Application Data

[63] Continuation-in-part of Ser. No. 817,564, Jan. 7, 1992.

[51] Int. Cl.[5] ..... H05B 1/02; F23Q 7/16

[52] U.S. Cl. ..... 219/268; 219/240; 219/267; 219/270; 219/533; 362/196; 362/205

[58] Field of Search ..... 219/260 ∝ 270, 219/533, 240; 362/196, 200, 201, 205

[56] References Cited

U.S. PATENT DOCUMENTS

| | | | |
|---|---|---|---|
| 1,686,579 | 10/1928 | Staats et al. | 219/262 |
| 2,525,040 | 10/1950 | Luthi | 219/266 |
| 2,535,665 | 12/1950 | Buyarsky | 219/268 |
| 3,351,736 | 11/1967 | Jacobson | 219/268 X |
| 3,354,291 | 11/1967 | Behrendt | 219/268 X |
| 3,379,856 | 4/1968 | Hirsch | 219/268 |
| 3,392,265 | 7/1968 | King et al. | 219/268 X |

FOREIGN PATENT DOCUMENTS

| | | | |
|---|---|---|---|
| 1203030 | 7/1959 | France | 219/268 |
| 2419467 | 11/1979 | France | 219/268 |
| 254621 | 12/1948 | Switzerland | 219/268 |
| 405887 | 2/1934 | United Kingdom | 219/268 |
| 494749 | 1/1937 | United Kingdom | 219/268 |
| 2232754 | 12/1990 | United Kingdom | 219/268 |

*Primary Examiner*—Anthony Bartis

*Attorney, Agent, or Firm*—Joseph C. Mason, Jr.; Ronald E. Smith

[57] ABSTRACT

A flameless portable cigarette lighter includes a hollow housing containing a pair of batteries and having a front wall with an opening sized to allow only the insertion of a cigarette therethrough for contact with a vertically oriented electric resistance heating filament in the housing for igniting the cigarette. A flexible closure is formed integrally with a switch actuator slidabaly mounted on the housing front wall and movable therewith from a first position closing the opening to a second position allowing access therethrough of a cigarette. A switch is provided in the housing for selectively connecting the batteries to the filament for energization thereof and includes a flexible resilient conductor having a free end movable into electrical contact with a pole of one of the batteries by engagement with a protuberance at the upper end of the closure when the closure is in its second position. The switch actuator is spring biased to return the closure to its first position when released to automatically close the opening and allow the conductor free end to separate from the battery pole under its own resilience to deenergize the filament.

3 Claims, 4 Drawing Sheets

BATTERY-OPERATED PORTABLE CIGARETTE LIGHTER WITH CLOSURE ACTUATED SWITCH

CROSS-REFERENCE TO RELATED DISCLOSURES

This disclosure is a continuation-in-part of a copending disclosure having the same title by the same inventor, Ser. No. 07/817,564, filed Jan. 7, 1992.

BACKGROUND OF THE INVENTION

1. Technical Field

This invention relates, generally, to portable cigarette lighters. More particularly, it relates to a flameless battery-operated lighter having a recessed lighting means.

2. Description of the Prior Art

Cigarette lighters commonly include a capillary action-dependent wick having a lower end immersed in a fuel and a rotatably mounted flint, disposed in closely spaced relation to the wick, that produces a spark when rotated against a fixed position abrasive member. These lighters have a number of well-known disadvantages relating to the need to maintain fuel therein, the inefficiency of the flint-based spark-producing means, and the like. Moreover, the lighters can be used to start fires, whether intentionally or not.

Additional drawbacks of such conventional lighters are equally well known. For example, the lighter fluid has an unpleasant smell. Moreover, the lighters are heavy and not inexpensive.

Many inventors have developed improvements to the common lighter. Chuange, in U.S. Pat. No. 4,507,704, discloses a battery-operated cigarette lighter that provides current that heats a heating element that is positioned within a housing. That device is believed to be the most pertinent of the earlier patents; however, its size, weight, and expense are not inconsiderable.

Additional U.S. patents of interest include U.S. Pat. Nos. 2,030,011, 2,528,619, 2,991,875, and 4,621,649.

Foreign disclosures of interest include Swiss Patent 245,621 and United Kingdom application 2,232,754.

Although the art of cigarette lighters is well-developed, there remains a need for a lighter that cannot be used to start intentional or unintentional fires. There is also a need for a very inexpensive and light in weight lighter.

SUMMARY OF THE INVENTION

Two AA penlight batteries, or equivalent, are housed in a small, light-in-weight plastic housing and are connected to one another in series to provide ample voltage and current to a spirally-wound Nichrome wire heating element when a switch is thrown. The heating element is positioned within the hollow cavity formed by the housing in recessed relation to a preselected sidewall of said housing, and said sidewall is apertured to provide access to said heating element. In this manner, a cigarette is lit by inserting its leading end through the aperture into abutting relation to the heating element. The recessed positioning of the heating element and the small diameter of the aperture prevents inadvertent and inhibits intentional setting of fires. A pivotally-mounted switch actuator means is biased into a normally open position by a torsion spring that is advantageously mounted to a peg positioned within the hollow interior of the housing.

In a second embodiment, the aperture is covered by a closure means when the lighter is not in use, and the user must open the aperture when it is desired to light a cigarette. Advantageously, opening the aperture closes the electrical circuit that includes the heating element, and closing the aperture opens said circuit and therefore deactivates the heating element. The switch actuator in said second embodiment is slidably mounted and includes a hump formed therein that slidably engages a mating hump formed in a preselected conductor in said electrical circuit when said actuator closes a switch.

A third embodiment provides a more elegant switch means, a longer-lasting filament, and a filament-protecting means. More particularly, the third embodiment includes a slidably mounted switch actuator that is biased into its switch-opening position by a bias means that is sandwiched between the top end of a recess formed in said actuator and a fixed position stop member that is mounted within the hollow interior of the lighter.

The primary object of this invention is to provide a small, light, inexpensive, battery-operated cigarette lighter.

Another important object is to provide a cigarette lighter that produces no flame and which is therefore safe to operate.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to like or similar parts throughout the several views of the drawings.

DETAILED DESCRIPTION OF THE PREFERRED EMBODIMENT

Figure 1:
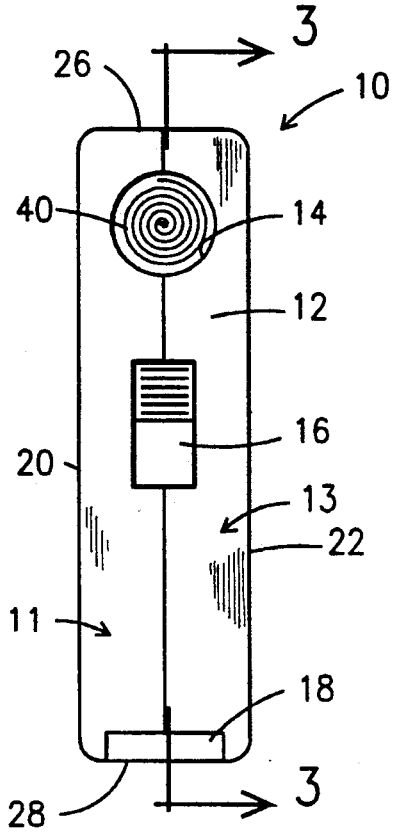
FIG. 1 is a front elevational view of the first embodiment of the invention.

Referring now to FIG. 1, it will there be seen that a first illustrative embodiment of the invention is denoted as a whole by the reference numeral 10. Lighter 10 has a hollow housing made of two mating casing halves 11 and 13 that meet along parting line 15.

Lighter 10 includes front wall 12 having preferably circular opening 14 formed therein; the predetermined diameter of opening 14 is slightly greater than the diameter of a standard-sized cigarette; its diameter is insufficient to fully receive a human finger. Reference numeral 16 indicates a switch actuator; the switch means with which it is associated will be more fully set forth hereinafter; its function is to close and open the electrical circuit as needed. Removable closure means 18 at the bottom of lighter 10 provides access to the battery compartment.

Figure 2:
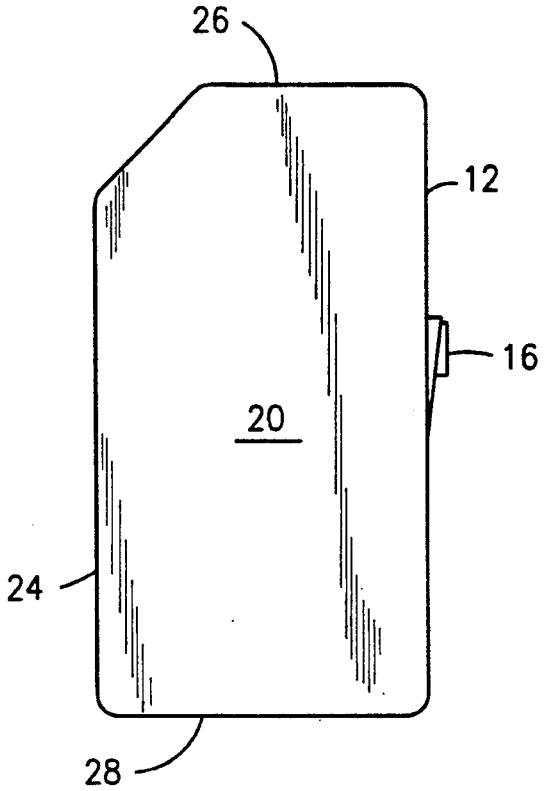
FIG. 2 is a side elevational view thereof.

As perhaps best understood by comparing FIGS. 1 and 2, lighter 10 has a generally parallelepiped construction; it includes side walls 20, 22, rear wall 24, top wall 26 and bottom wall 28. The walls define a hollow cavity within which are positioned the batteries, the electrical conductors, the mounting means for switch actuator 16, and the heating element. The walls are of thin but durable plastic construction so that the lighter 10 is light-in-weight and small.

Figure 3:
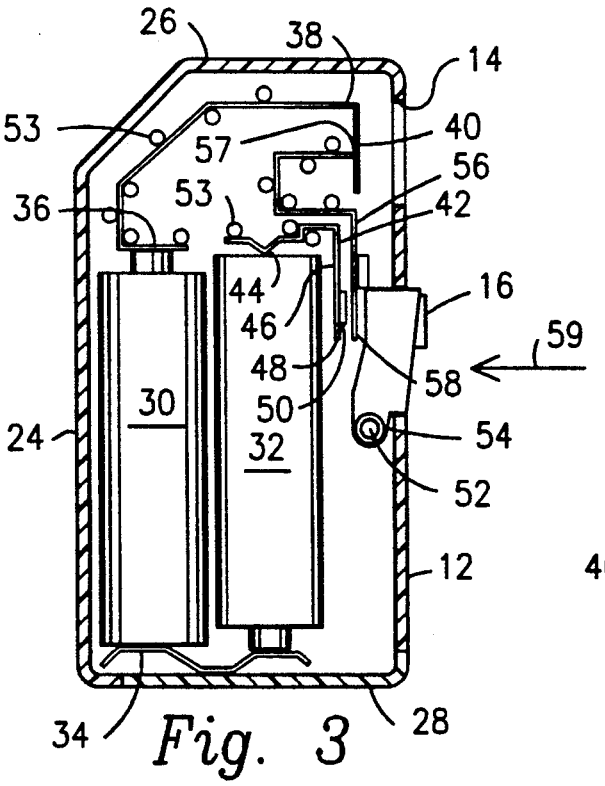
FIG. 3 is a sectional view taken along line 3—3 in FIG. 1.

As shown in FIG. 3, batteries 30 and 32 are conventional AA penlight batteries, or other suitable equivalent; a first quarter inch wide sheet metal conductor 34 is in simultaneous electrical communication with the negative pole of battery 30 and the positive pole of battery 32 as depicted at the bottom of FIG. 3. The positive pole of battery 30 is in electrical communication with a second conductor 36 of like construction; said conductor 36 is bent several times as shown and terminates in terminal 38 of heating element 40.

The negative pole of battery 32 is in electrical communication with a third quarter inch wide sheet metal conductor 42; it is bent as shown to include a point 44 to ensure a good contact. Conductor 42 further includes a section 46 that is disposed in parallel relation to battery 32 and front wall 12. Importantly, section 46 has a free distal end 48 that is not mounted to anything. Moreover, an electrical contact 50 is secured to said distal end 48 on the side thereof facing away from the battery as shown.

Switch actuator 16 is pivotally mounted to a peg 52 that extends between side walls 20 and 22. A torsion spring 54 encircles said peg 52 and biases switch actuator 16 away from contact 50 so that no current may flow from batteries 30, 32, when switch actuator 16 is in repose; both FIGS. 2 and 3 show said switch actuator in said position of repose.

A fourth quarter inch wide sheet metal conductor 56 has a distal free end 58 secured to switch actuator 16 and its opposite end is secured to terminal 57 of heating element 40. Thus, when switch actuator 16 is pushed in the direction indicated in FIG. 3 by directional arrow 59, free end 58 of conductor 56 makes abutting contact with contact 50 of conductor 46 and an electrical circuit is completed, thereby causing current to flow through heating element 40.

Figure 4:
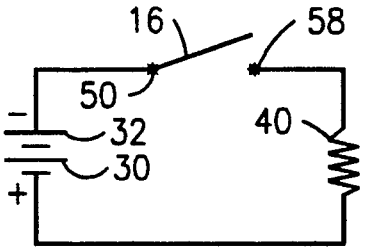
FIG. 4 is a schematic diagram of the electrical circuit of the present invention.

In the claims that follow, and as depicted in FIG. 4, contact 50 of conductor 46 is referred to as the first contact of the switch means and the distal free end 58 of conductor 56 is referred to as the second contact of the switch means.

Figure 5:
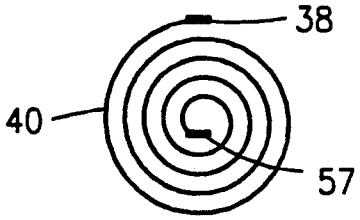
FIG. 5 is an elevational view of the heating element employed in the first embodiment of the novel lighter.

Element 40 is a relatively tightly wound spiral winding of Nichrome, as shown in FIGS. 1 and 5. Accordingly, it heats up quickly and soon attains a temperature sufficient to light a cigarette; it has a length of about four inches, and a diameter substantially equal to the diameter of a cigarette.

As shown in FIG. 3, heating element 40 is recessed with respect to front wall 12; note also that the plane of the heating element is parallel to said front wall 12. The leading end of a cigarette must be inserted substantially squarely through opening 14 to light said cigarette. This is an important safety feature and prevents the heating element 40 from coming into contact with anything other than the leading end of a cigarette. The depth of the recess is sufficient to prevent a human finger from reaching heating element 40. Since circular opening 14 is spaced from switch actuator 16 by a predetermined extent of front wall 12, the only access to the heating element is through said circular opening.

Moreover, the bias on switch actuator 16 further ensures that the current flowing through said heating element will be shut off when said switch actuator 16 is released, i.e., the actuator assembly acts as a dead man switch. Note further that conductor 56 is inherently resilient so that actuator 16 is biased outwardly, i.e., away from contact 50, even in the absence of torsion spring 54.

It should also be noted that a plurality of pegs, collectively denoted 53, provide means for retaining the conductors 36, 46, and 56 in place. Each peg 53 has the same structure as pivot peg 52, i.e., each peg extends between side walls 20 and 22, in interconnecting relation thereto. Pegs 53 are specifically positioned to form the respective paths of travel of conductors 36, 46, and 56, as shown.

FIGS. 6–10 show the second embodiment of this invention; it is denoted 60 as a whole. Many of the parts thereof are similar as the first embodiment, and the same reference numerals have been used to identify those parts. The primary difference is the provision of an imperforate closure means 62 for closing cigarette-receiving opening or aperture 14 when the lighter is not in use, and the switching means that activates the heating element only when the aperture is open.

Figure 6:
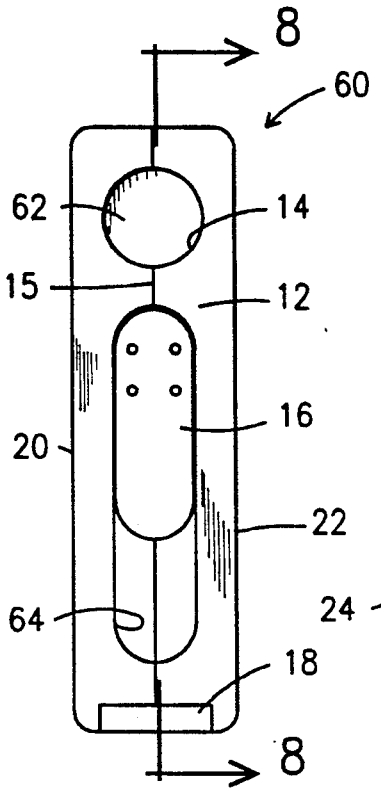
FIG. 6 is a front elevational view of a second exemplary embodiment of the invention when the switch is in its "off" position.
Figure 7:
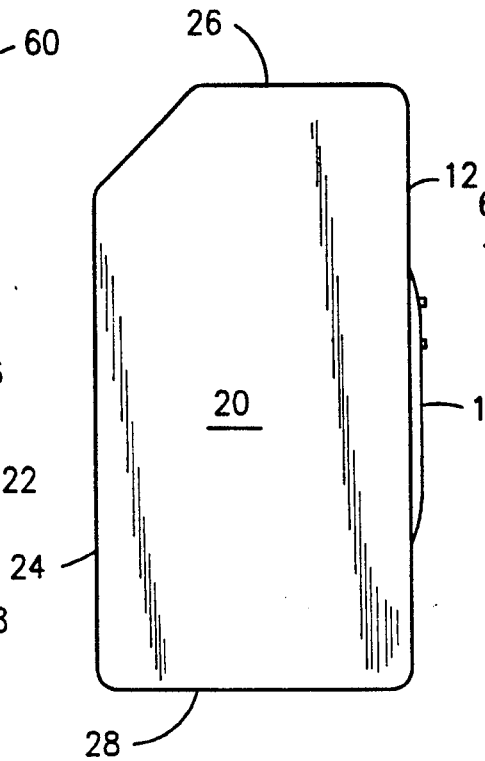
FIG. 7 is a side elevational view of said second embodiment.
Figure 8:
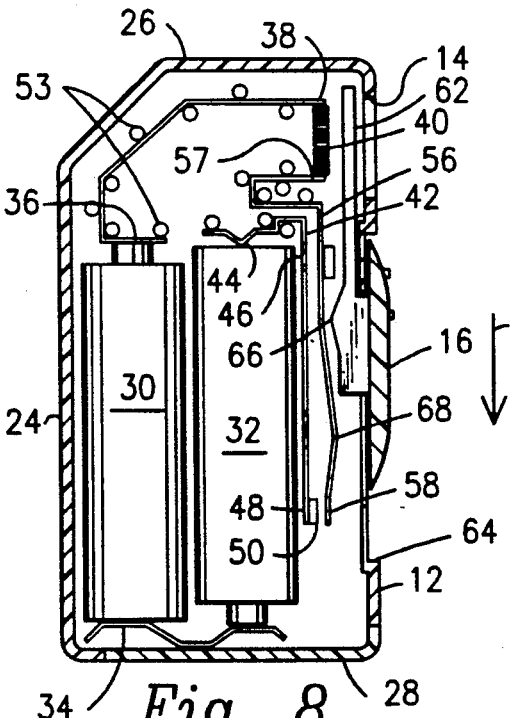
FIG. 8 is a sectional view taken along line 8—8 in FIG. 6.

Switch actuator 16A of this embodiment is slidably mounted and includes an upwardly extending flat part 62 that is integrally formed therewith or otherwise fixedly secured thereto and which serves as the closure means for aperture 14. An elongate actuator-accommodating slot 64 (FIGS. 6 and 9), is formed in front wall 12 of the casing formed by casing halves 11A and 13A so that actuator 16A can be slid from its uppermost position as depicted in FIGS. 6 and 8 to its lowermost position, shown in FIGS. 9 and 10. Directional arrow 63 in FIG. 8 indicates the motion of the actuator required to slide it from its uppermost position to its lowermost position, and arrow 65 in FIG. 10 indicates the motion required to slide it from its lowermost position to its uppermost position.

Figure 9:
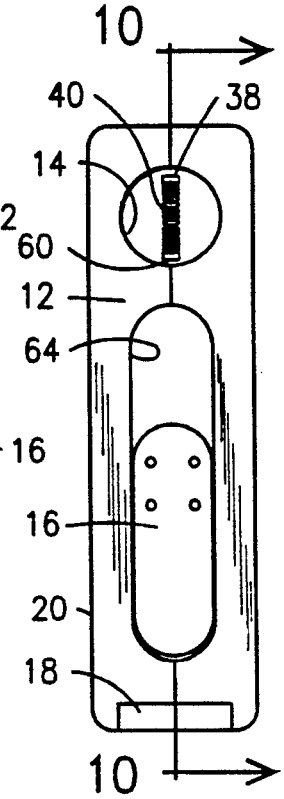
FIG. 9 is a front elevational view of the second embodiment when the switch is in its "on" position.

As shown in FIGS. 6 and 8, when actuator 16A is in its uppermost position, closure means 62 closes aperture 14. However, the aperture is not closed by part 62 when said actuator 14 is in its lowermost position as shown in FIGS. 9 and 10.

Figure 10:
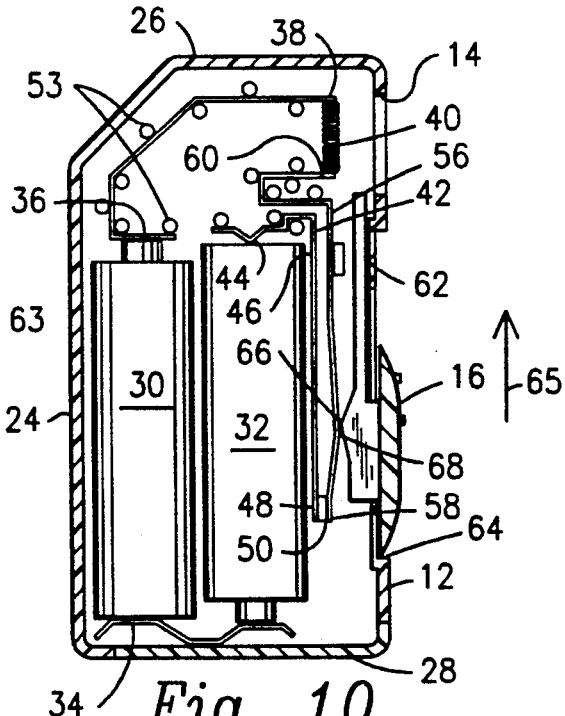
FIG. 10 is a sectional view taken along line 10—10 in FIG. 9.
Figure 11:
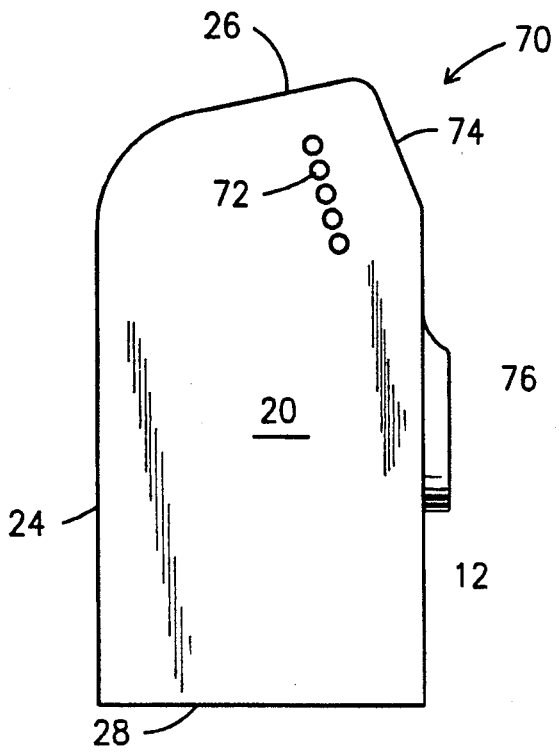
FIG. 11 is a side elevational view of a third embodiment.
Figure 12:
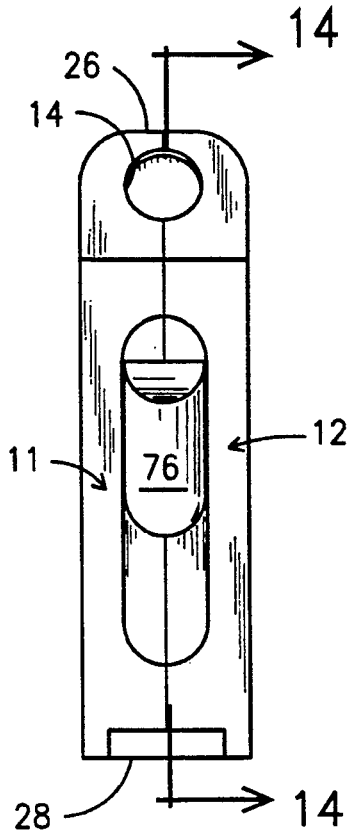
FIG. 12 is a front elevational view of said third embodiment with the switch in its OFF position.
Figure 13:
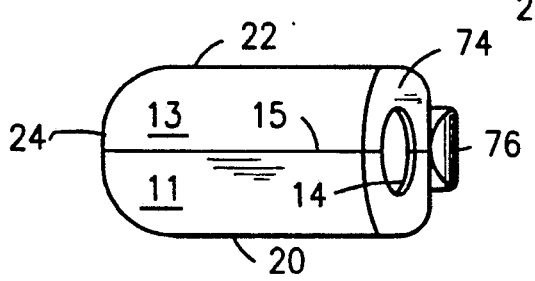
FIG. 13 is a top plan view thereof.

Note in FIG. 8 that when actuator 16A is in said uppermost position, the electrical circuit is open so that no current may flow through heating element 40A (shown in side elevation in FIGS. 8 and 10). A hump 66 (FIG. 8) is formed integrally with actuator 16A, and a pair of smooth ramps extend downwardly from said hump as depicted. A longitudinally spaced apart corresponding hump 68 is formed in conductor 56A. Note the spacing between contact 50 at the lowermost end 48 of conductor 46 in FIG. 8 and the distal free end 58A of conductor 56A. Accordingly, as depicted in FIG. 10, when actuator 16A is slid downwardly, the actuator and conductor ramps slidably engage one another and the distal free end 58A of conductor 56A is driven into abutting relation to contact 50. In the claims that follow, contact 50 is referred to as the first contact of the switch means and the distal free end 58A of conductor 56A is referred to as the second contact of the switch means. Current flows through heating element 40A only when contact 50 abuts distal free end 58A, and said abutment can take place only when closure means 62 is open.

When actuator 16A is moved back to its FIG. 8 position from its FIG. 10 position, the resiliency of conductor 56A returns it to its FIG. 8 position. Thus, there is no need for torsion spring 54 of the first embodiment, i.e., conductor 56A, being a flat strip of metal, serves as its own biasing means.

Note that heating element 40A in this embodiment is different from element 40A in the first embodiment, i.e., it is a linear element wound in a helix. Element 40A spans opening 14 diametrically as perhaps best shown in FIG. 9. Other orientations are within the scope of this invention.

The third embodiment is depicted in FIGS. 11-17 and is denoted 70 as a whole; reference numerals similar to those of the first two embodiments are used for similiar parts. Plural ventilation holes 72 (FIGS. 11, 14 and 15) are formed in casing halves 12B, 13B they perform the function their name expresses.

Figure 14:
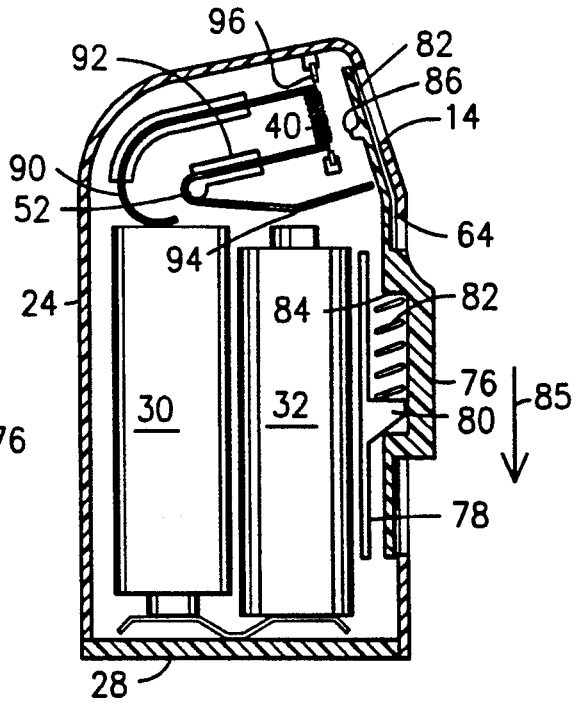
FIG. 14 is a sectional view taken along line 14—14 in FIG. 12.
Figure 15:
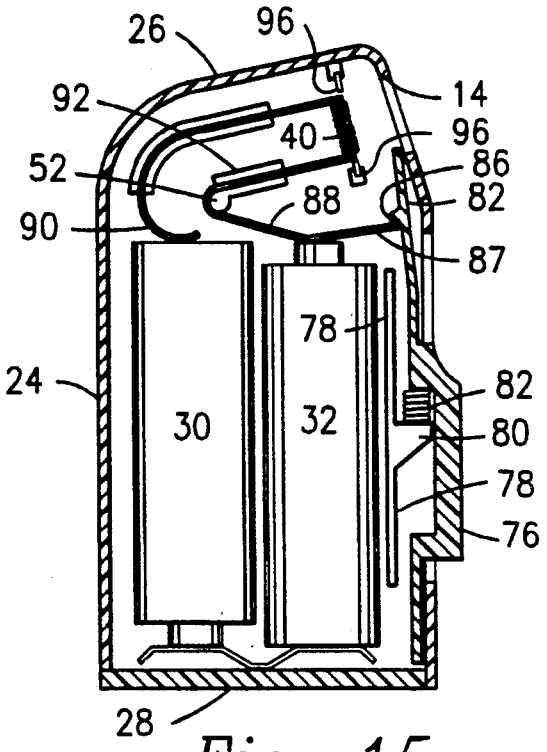
FIG. 15 is a sectional view similar to FIG. 14 but showing the switch in its ON position.
Figure 16:
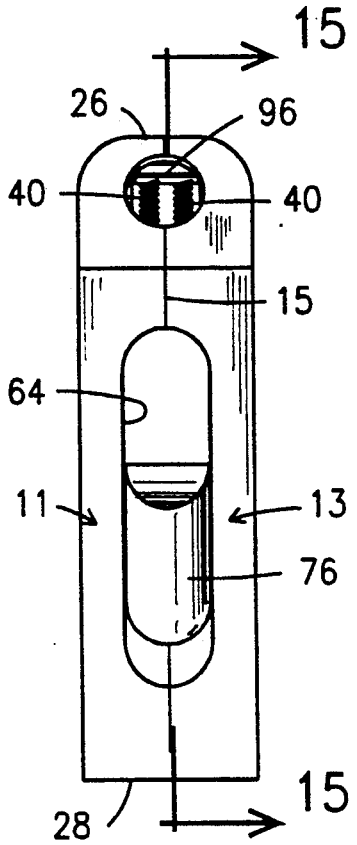
FIG. 16 is a view like FIG. 12 but showing the switch in its ON position.

A rearward slope 74 is provided in housing 70 to deflect rearwardly slidably mounted flexible closure means 82 so that it seals tightly against opening 14 when it closes said opening, as best understood in connection with FIGS. 14 and 15; the depicted thinness of said closure means 82 provides the needed flexibility and resiliency.

Lighter 70 is shown in its condition of repose in FIGS. 11-14. As best understood in connection with FIG. 14, the switch actuator of this embodiment is denoted 76 as a whole; it includes a flat base plate 78 mounted in closely spaced relation to battery 34. The opposite edges of base plate 78 are secured to sidewalls 20,22 of casing halves 11B, 13B, respectively, to hold it against movement. A stop member 80 is formed integrally with said base plate; it supports the lowermost ends of bias means 82. The uppermost end of bias means 82 abuts top wall 84 of switch actuator 76. When actuator 76 is pushed downwardly as indicated by directional arrow 85 in FIG. 14, bias means 82 is compressed as shown in FIG. 15 because stop member 80 is fixedly secured against movement.

A protuberance 86 (FIGS. 14 and 15) abuttingly engages flexible conductor 88 when actuator 76 is slid downwardly; note in FIG. 15 that said conductor 88 is in electrical communication with the positive pole of battery 32 when actuator 76 is in its down or ON position; this completes the circuit through filament 40B because conductor 90 is in permanent electrical engagement with the negative pole of battery 30.

The "J" shaped configuration of conductor 90 is novel, as is the shape of conductor 88. Conductor 88 has a first end in permanent engagement with filament 40B as depicted and a second end 87 that is free, as depicted in FIG. 14, when bias means 82 is in repose. A linear-in-configuration mounting channel 92 securely holds that part of conductor 88 that extends from the lowermost end of filament 40B to peg 52. The conductor 88 bends around said peg 52 as shown, i.e., the angle is less than 180 degrees, and a bend 94 is formed in the second part of said second conductor to provide a good electrical contact between said conductor 88 and said positive pole of battery 32.

Importantly, conductor 88 is spaced apart from said positive pole of battery 32 when conductor 88 is in repose as depicted in FIG. 14. Just as importantly, conductor 88 is resilient so that it returns to said position of repose when it is released from its FIG. 15 position by upward travel of said protuberance 86. Said upward travel of said protuberance occurs upon release of actuator 76 because the bias of bias means 82 returns actuator 76 and hence protuberance 86 to their respective positions of repose as depicted in FIG. 14. As in the second embodiment, current flows through filament 40B only when said filament is exposed, i.e., when cover 82 is retracted as shown in FIG. 15.

A filament-protecting device in the form of a metallic frame is denoted 96 as a whole. It is positioned flush with filament 40B and is rigidly mounted so that it is not displaced when a cigarette is pressed against it. Thus, the advance of a leading end of the cigarette toward the filament is stopped by protector 96 so that the filament is not damaged. The flush mounting ensures that the cigarette will be lit.

Figure 17:
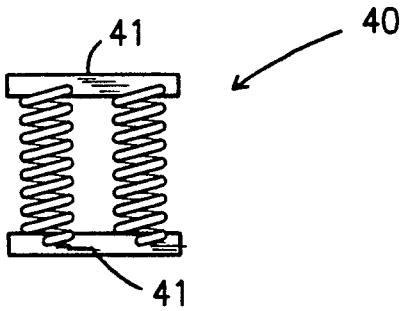
FIG. 17 is a front elevational view of the filament of the third embodiment.

The novel filament 40B of this third embodiment is provided in the form of a pair of parallel filament members. Each filament is a thirty nine gage Nichrome 60 wire wound in a coil of approximately 0.040 inch diameter, five to seven wraps, spot welded to a flat wire 41 at each end as depicted in FIG. 17.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A lighter, comprising:

a hollow housing;

said hollow housing being formed of a plastic material and having a generally parallelepiped configuration including a top wall, a bottom wall, a front wall, a rear wall, and a pair of side walls;

a battery means disposed within said housing;

said battery means including a first and a second battery, said first battery being positioned between said second battery and said front wall of said housing, said second battery being positioned between said first battery and said rear wall of said housing;

an electrical circuit disposed within said housing connected to and connected for energization by said battery means;

a switch means for opening and closing said electrical circuit;

a heating element forming part of said electrical circuit and being energized when said switch means is closed;

said heating element being generally oriented in a vertical plane and having a lowermost end and an uppermost end;

a cigarette-receiving circular opening of predetermined diameter being formed in said front wall of said housing;

a slidably mounted closure means on said front wall of said housing for selectively opening and closing said opening;

a slidably mounted switch actuator means on said front wall of said housing and having an exteriorly exposed manually engageable portion for operating the actuator means;

said closure means and said switch actuator means being fixedly secured to one another so that movement of said switch actuator means is simultaneously communicated to said closure means;

said circular opening and said heating element being spaced apart from one another so that access to said heating element can be obtained only through said circular opening, and said predetermined diameter of said circular opening being insufficient to receive a human finger to the extent necessary to contact said heating element;

said switch actuator means having a first position where said switch means is open and said closure means is disposed in closing relation to said opening;

said switch actuator means having a second position where said switch means is closed and said closure means is disposed in retracted relation to said opening;

said switch means including a first conductor disposed in selective electrical communication between said lowermost end of said heating element and said first battery;

said first conductor being formed of a flexible, resilient material and having a first end permanently secured to said lowermost end of said heating element and a free second end having a first, in repose, position where it is spaced apart from said first battery and a second position where it is in electrical communication with said first battery;

said circuit further including a second conductor having a first end in permanent engagement with the uppermost end of said heating element and a second end in permanent engagement with said second battery; and a protuberance formed in said closure means on an interior side thereof, said protuberance specifically positioned near an uppermost end of said closure means and being adapted to abuttingly engage said free second end of said first conductor and to displace said free second end into electrical communication with said first battery when said switch actuator means is in its second position;

said first conductor returning to its first position under its own resiliency when said switch actuator is returned to its first position.

2. A flameless cigarette lighter, comprising:

a hollow housing made of two mating casing halves;

a filament disposed within said hollow housing, in recessed relation to an outer surface thereof;

said filament being generally oriented in a vertical plane and having a lowermost end and an uppermost end;

said hollow housing including a front wall and a rear wall;

an opening formed in said front wall, said opening having a size sufficient to receive therein the leading end of a cigarette and insufficient to receive therein the leading end of a human finger to the extent necessary for said finger to touch said filament;

a pair of batteries disposed in said hollow housing in side-by-side relation to one another;

said pair of batteries including a first and a second battery, said first battery being positioned between said second battery and said front wall of said housing, said second battery being positioned between said first battery and said rear wall of said housing;

switch means in said housing in circuit with said pair of batteries and said filament for controlling the energization of said filament;

a flat, fixed position base plate disposed within said housing in closely spaced relation to said first battery and to said front wall;

a stop member that projects outwardly from said base plate into the space between said front wall and said base plate;

a switch actuator means that is slidably mounted in the space between said base plate and said front wall of said housing for selectively actuating said switch means;

said switch actuator means having an elongated recess formed therein for slidably receiving said stop member;

a bias means disposed within said recess means, said bias means being captured between a first end of said recess means and said stop member, said bias means urging said switch actuator means into a position of repose;

a flexible closure means formed integrally with said switch actuator means and movable therewith relative to said front wall between a first position closing said opening and a second position wherein the opening is open to allow access of a cigarette into the interior of the housing;

said flexible closure means being in its first position when said switch actuator means is in its repose position;

said flexible closure means being retracted to its second position when said switch actuator is operated to actuate said switch means;

said switch means including a first conductor disposed in selective electrical communication between said lowermost end of said filament and said first battery;

said first conductor being formed of a flexible, resilient material and having a first end permanently secured to said lowermost end of said filament and a free second end having a first, in repose, position where it is spaced apart from said first battery and a second position where it is in electrical communication with said first battery;

a second conductor having a first end in permanent engagement with the uppermost end of said filament and a second end in engagement with said second battery; and a protuberance formed in said closure means on an interior side thereof, said protuberance specifically positioned near an uppermost end of said closure means and being adapted to abuttingly engage said free second end of said first conductor and to displace said free second end into electrical commuciation with said first battery when said switch actuator means is in its second position.

3. The flameless cigarette lighter of claim 2, wherein said filament includes a pair of parallel filament members, each of which is made of thirty nine gage Nichrome wire.

* * * * *